United States Patent [19]

Miller

[11] Patent Number: 4,824,063

[45] Date of Patent: Apr. 25, 1989

[54] DRYING BOARD

[76] Inventor: Arthur F. Miller, 766 Carnation Lane, Fallbrook, Calif. 92028

[21] Appl. No.: 197,691

[22] Filed: May 23, 1988

Related U.S. Application Data

[63] Continuation-in-part of Ser. No. 36,335, Apr. 9, 1987, abandoned.

[51] Int. Cl.[4] ..... A47B 91/00

[52] U.S. Cl. ..... 248/346; 34/239; 432/259

[58] Field of Search ..... 248/346, 127, 176, 461; 211/13; 432/259; 34/238, 239

[56] References Cited

U.S. PATENT DOCUMENTS

| | | | |
|---|---|---|---|
| 635,423 | 10/1899 | Chase | 34/238 |
| 1,963,242 | 6/1934 | Nelson | 34/238 X |
| 2,030,707 | 2/1936 | McLean | 432/259 |
| 3,168,363 | 2/1965 | Monsour | 248/461 X |
| 3,545,097 | 12/1970 | Waltrich | 34/238 |
| 4,184,840 | 1/1980 | Gamberg | 432/259 X |
| 4,311,942 | 2/1943 | Hagemeyer | 432/259 |
| 4,405,300 | 9/1983 | Lubowsky | 432/259 X |
| 4,606,463 | 8/1986 | Stavis | 211/13 |

*Primary Examiner*—J. Franklin Foss

*Attorney, Agent, or Firm*—Calif Kip Tervo

[57] ABSTRACT

The drying board supports a freshly coated article during drying and includes a plurality of rigid upright projections extending upward from a rigid support structure. Each projection has base connected to the support structure and terminates in an upper end. The projection upper ends define a support plane for supporting a freshly coated article during drying. The projections are spaced apart to allow air flow to the supported side of the coated article. In an exemplary embodiment, the projections are randomly positioned such as not to present a pattern on the object and yet to provide a substantially uniform support area for said support plane. The projections are asymmetrically positioned relative to the perimeter of the support structure such that one drying board may be inverted and stacked upon another such that their perimeters are congruent and such that the projections do not interfere with one another.

14 Claims, 3 Drawing Sheets

DRYING BOARD

This application is a continuation-in-part of application Ser. No. 036,335 filed Apr. 9, 1987, now abandonded.

BACKGROUND OF THE INVENTION

1. Field of the Invention

This invention is a board for supporting a coated article during drying without leaving discernible support marks. It is particularly applicable to small art objects.

2. Background of the Invention

In the process of coating articles, such as with paint or varnish, one side is often left uncoated so that the article can rest on that side while the other sides dry. If a freshly coated side is rested on a support surface the fresh coat is marred or adheres to the surface. After the fresh coating dries, the non-coated side can be turned up and coated. This two-step procedure is time consuming, and is also often wasteful of coating material as the first remainder may have to be discarded and new coating opened or mixed.

Therefore it is desirable to have a means for supporting a freshly coated article during drying which will not noticeably mar the surface or adhere to the coating.

SUMMARY OF THE INVENTION

The drying board supports a freshly coated article during drying and includes a plurality of rigid upright projections extending upward from a rigid support structure. Each projection has base connected to the support structure and terminates in an upper end. The projection upper ends define a support plane for supporting a freshly coated article during drying. The projections are spaced apart to allow air flow to the supported side of the coated article. In an alternate exemplary embodiment, the projections are randomly positioned such as not to present a pattern n the object and yet to provide a substantially uniform support area for said support plane.

The projections are asymmetrically positioned relative to the perimeter of the support structure such that one drying board may be inverted and stacked upon another such that their perimeters are congruent and such that the projections do not interfere with one another.

Other features and many attendent advantages of the invention will become more apparent upon a reading of the following detailed description together with the drawings in which like reference numerals refer to like parts throughout.

DETAILED DESCRIPTION OF THE INVENTION

Figure 1:
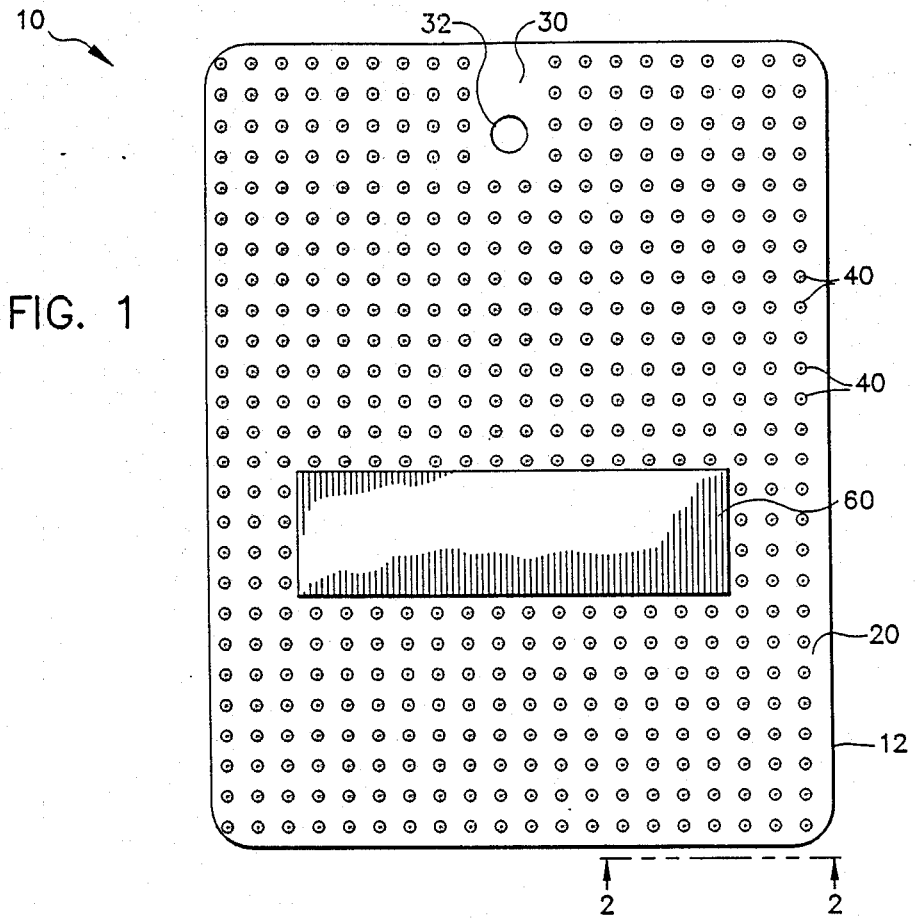
FIG. 1 is a top view of an exemplary embodiment of the drying board of the present invention having patterned conical projections and supporting an article.
Figure 2:
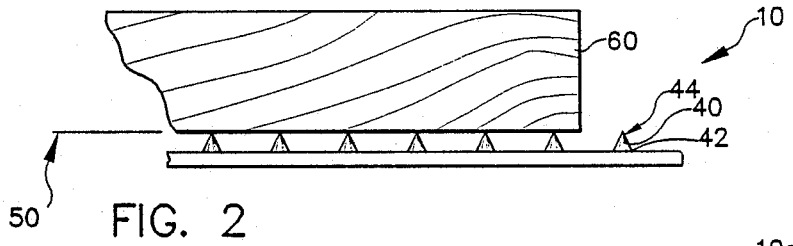
FIG. 2 is an enlarged cross-section of a portion of the board of FIG. 1 taken on line 2—2.
Figure 3:
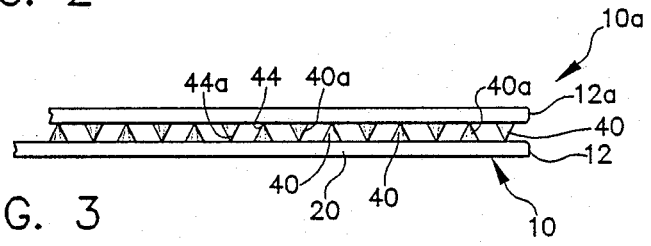
FIG. 3 is an enlarged cross-section of portions of two boards, similar to FIG. 2, shown in inverted stacking position.

With reference now to the drawing, there is shown in FIGS. 1–3 an exemplary embodiment of the drying board of the present invention. FIG. 1 is a top view of an exemplary embodiment of the drying board of the present invention having patterned conical projections and supporting an article. FIG. 2 is an enlarged cross-section of a portion of the board of FIG. 1 taken on line 2—2. The board, denoted generally as 10, includes a support structure 20 which supports a plurality of projections 40. Drying board 10 has an outer perimeter 12. Each projection 40 has a base 42 connected to support structure 20 and extends upward and terminates in an upper end, denoted generally as 44. The upper ends 44 of all projections 40 define a flat support plane 50 for supporting an article, such as board 60 during drying. Preferably, end 44 is pointed, or nearly so, such that for each projection 40 only very small surface touches article 60. If the support area of projection 40 is defined as the cross-sectional area 0.005 inches from end 44, then it has been found preferable that the support area be less than 0.002 inches so that an individual projection leaves only an imperceptible small mark, if any, on supported article 60. Also, there should be a sufficient number of projections 40 such that supported article 60 is not penetrated. Thus, it is important on one hand that the support area of each projection remain small and, on the other hand that the total support area be large enough to prevent penetration.

An important ratio in this regard is the support ratio; defined as the ratio of the support area to total area. A support ratio of 0.00047 has been found to be adequate for supporting light art objects. For larger, heavier articles, a larger support ratio is required. It is desirable to use a smaller support ratio. When too large a support ratio is used and ends 44 are too close together, the coated surfaces can take on a dimpled appearance.

In the exemplary embodiment of FIGS. 1–3, projections 40 are conical with an internal angle of 45 degrees and a height of 0.125 inches. Projections 40 terminate in a 0.005 inch radius tip. Projections 40 are spaced 0.5 inches apart. Preferably, drying board 10 and projections 40 are made of material which will not adhere to paint or other coatings. They should be non-porous and easy to clean. Suitable materials include polypropylene or polystyrene. The board 10 may be injected molded of these or similar materials, whereby board 10 and projections 40 are integral and of one material.

As seen in FIG. 1, support structure 20 includes a gripping area 30 devoid of projections so board may be easily hand held and maneuvered without puncture wounds to the user's fingers. Bore 32 thru support structure 20 allows the device 10 to be hung.

In FIG. 3, a second board 10a is inverted and stacked on first board 10. Second board 10a is identical to board 10. Because of the asymmetrical positioning of projections 40 relative to perimeter 12 (see FIG. 1), boards 10, **10*a* may be stacked in this manner with congruent perimeters 12, 12*a* and non-interfering projections 40, 40*a*. This allows for the carrying and stacking of drying boards without damaging projection ends 44, 44*a***.

Figure 4:
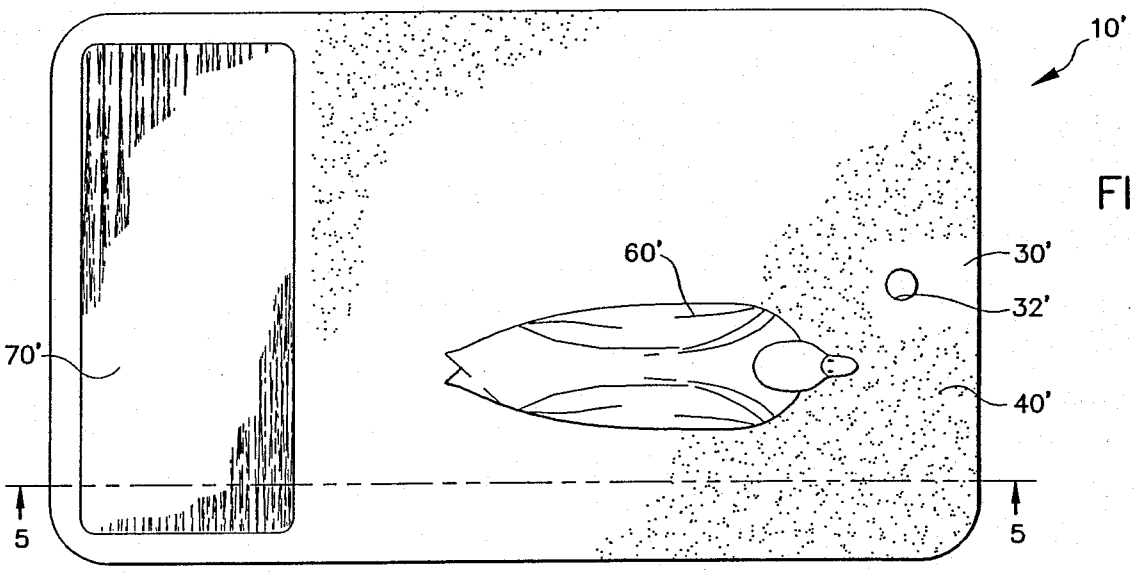
FIG. 4 is a top view of an alternate exemplary embodiment of the drying board of the present invention having randomly positioned projections and supporting an article.
Figure 5:
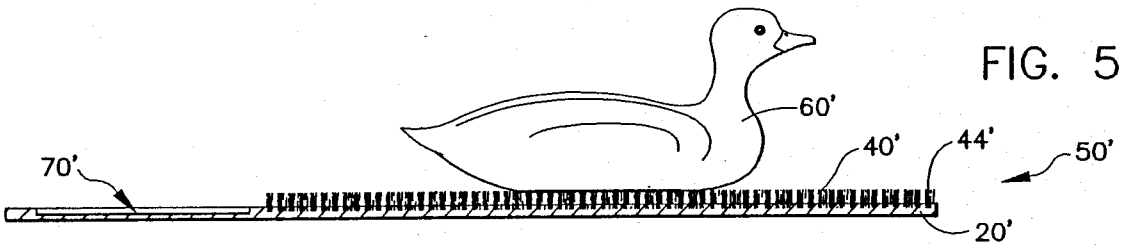
FIG. 5 is a side view of the board and supported article of FIG. 4.
Figure 6:
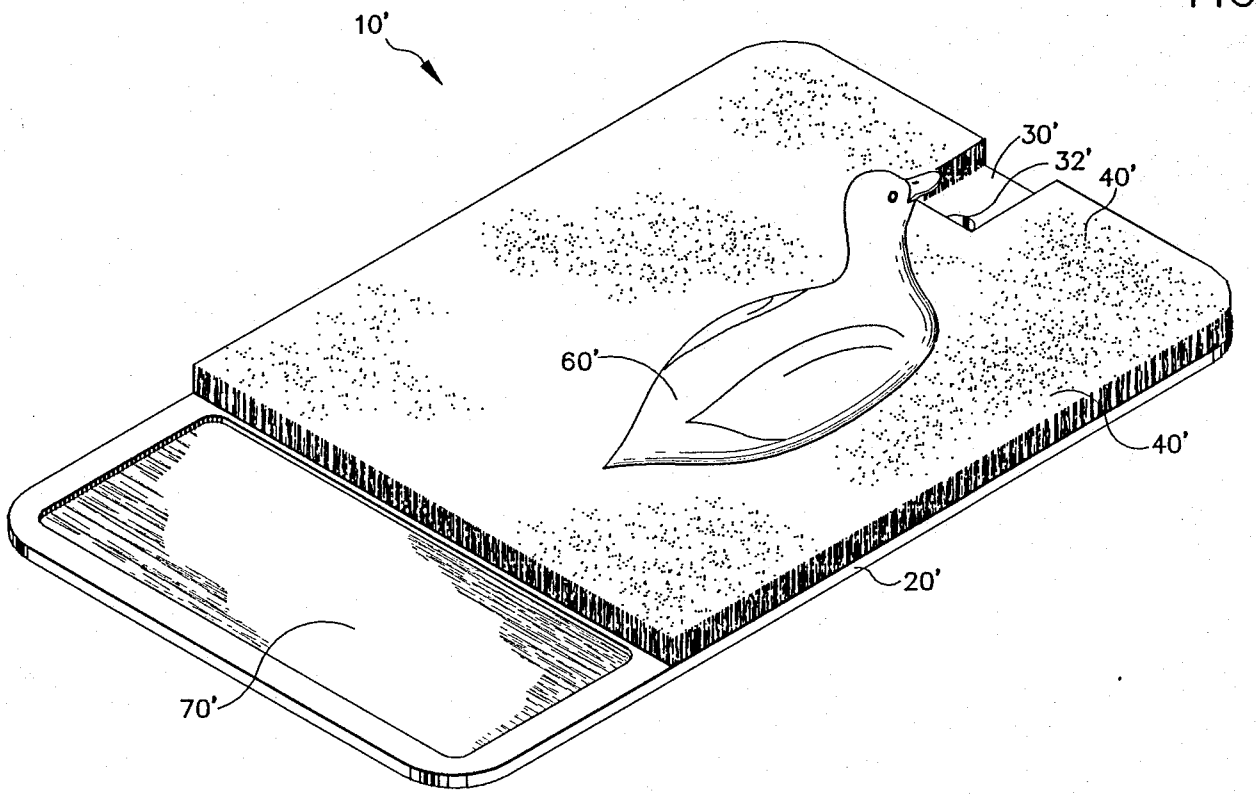
FIG. 6 is a perspective view of the drying board of FIG. 4.

With reference now to FIGS. 4–6 there is shown an alternate exemplary embodiment of the drying board 10′ of the present invention having randomly positioned projections 40′ and supporting an article 60′. FIG. 4 is a top view. FIG. 5 is a side view of the board 10′ and supported article 60′ of FIG. 4, and FIG. 6 is a perspective view of the drying board 10′ of FIG. 4. Rigid support structure 20′ supports projections 40′ which terminate in ends 44′ defining support plane 50′. Projections 40′ are rigid columns and may be of suitable material. Strong plastic or wire of approximately 0.020 inches diameter terminating in a point has been found suitable.

Occasionally the pattern of the projection ends is visible on the dried coated article. This results from certain types of coatings and when large heavy articles are supported and an adequate support ration cannot be easily obtained. This visible support pattern is undesirable. For this reason, projections 40′ are randomly positioned for it has been found that random indentations are not so easily detectable. Board 10′ additionally includes a blending palette 70′ which is an area devoid of projections 40′. Blending palette 70′ is recessed into support structure 20′ (see FIG. 5) and has a textured surface.

Although particular embodiments of the invention have been illustrated and described, various changes may be made in the form, construction, and arrangement of the parts herein without sacrificing any of its advantages. Therefore, it is to be understood that all matter herein is to be interpreted as illustrative and not in any limiting sense, and it is intended to cover in the appended claims changes as come within the true spirit and scope of the appended claims.

I claim:

1. A device for supporting a freshly coated article during drying comprising:
- a rigid support structure; and
- a plurality of rigid upright projections extending upward from said support structure; each projection including:
  - a base connected to said support structure; and
  - a terminating upper end;

and wherein:
- said upper ends of said projections define a support plane for substantially uniformly supporting a freshly coated article during drying; and
- said projections are spaced apart to allow air flow to the supported side of the coated article; and wherein
- said support structure includes a gripping portion devoid of said projections.

2. The device of claim 1 wherein the support area of a projection is less than 0.002 square inches.

3. The device of claim 1 wherein the support ratio is sufficient to prevent indenting of a supported article by said projections.

4. The device of claim 1 wherein the support ratio of said projections is greater than 0.00047.

5. The device of claim 1 wherein:
- said support structure defines an outer perimeter; and
- said projections are asymmetrically positioned relative to said perimeter such that one said device may be inverted and stacked upon another said device such that their perimeters are congruent and such that said projections do not interfere with one another.

6. The device of claim 1 including: a blending palette connected to said support structure.

7. A device for supporting a freshly coated article during drying comprising:
- a rigid support structure; and
- a plurality of rigid upright projections extending upward from said support structure; each projection including:
- a base connected to said support structure; and
- a terminating upper end; and wherein;
- said upper ends of said projections define a support plane for supporting a freshly coated article during drying;
- said projections are spaced apart to allow air flow to the supported side of the coated article; and
- said projections are randomly positioned such as not to present a pattern and yet to provide a substantially uniform support area for said support plane.

8. The device of claim 7 wherein the support area of a projection is less than 0.002 square inches.

9. The device of claim 7 wherein the support ratio is sufficient to prevent indenting of a supported article by said projections.

10. The device of claim 7 wherein the support ratio of said projections is greater than 0.00047.

11. The device of claim 7 wherein:
- said support structure defines an outer perimeter; and
- said projections are asymmetrically positioned relative to said perimeter such that one said device may be inverted and stacked upon another said device such that their perimeters are congruent and such that said projections do not interfere with one another.

12. The device of claim 7 including:
- a blending palette connected to said support structure.

13. The device of claim 7 wherein said support structure includes a gripping portion devoid of said projections.

14. A device for supporting a freshly coated article during drying comprising:
- a rigid support structure; and
- a plurality of rigid upright projections extending upward from said support structure; each projection including;
- a base connected to said support structure; and
- a terminating upper end; and wherein:
- said upper ends of said projections define a support plane for substantially uniformly supporting a freshly coated article during drying; and
- said projections are spaced apart to allow air flow to the supported side of the coated article; and wherein
- said support structure defines an outer perimeter; and
- said projections are asymmetrically positioned relative to said perimeter such that one said device may be inverted and stacked upon another said device such that their perimeters are congruent and such that said projections do not interfere with one another; and further including
- a blending palette connected to said support structure; and wherein
- said support structure includes a gripping portion devoid of said projections.

* * * * *